US005290152A

United States Patent [19]

Wallace et al.

[11] Patent Number: 5,290,152

[45] Date of Patent: Mar. 1, 1994

[54] MANIFOLD FOR A LIQUID RING VACUUM PUMP-COMPRESSOR

[75] Inventors: T. Michael Wallace; Charles H. Wunner, both of Charlotte, N.C.

[73] Assignee: Vooner Vacuum Pumps, Inc., Charlotte, N.C.

[21] Appl. No.: 911,197

[22] Filed: Jul. 9, 1992

Related U.S. Application Data

[63] Continuation-in-part of Ser. No. 882,820, May 14, 1992, Pat. No. 5,246,348.

[51] Int. Cl.[5] ..... F04C 19/00

[52] U.S. Cl. ..... 417/68; 15/104.11; 15/104.05; 134/22.11; 137/561 A; 239/117; 239/553.3; 239/600; 285/132; 285/137.1; 415/118; 415/183

[58] Field of Search ..... 415/118, 183, 201, 202, 415/214.1; 417/68, 69, 454; 60/739; 134/6, 22.1, 22.11; 15/104.011, 104.05; 137/561 A; 239/553, 553.3, 114, 117, 575, DIG. 23, 600; 285/132, 137.1, 150

[56] References Cited

U.S. PATENT DOCUMENTS

| | | | |
|---|---|---|---|
| Re. 29,747 | 8/1978 | Roe et al. . | |
| 953,171 | 3/1910 | Kraeuter | 15/104.011 |
| 959,352 | 5/1910 | Kellett | 415/202 |
| 1,073,824 | 9/1913 | Smith | 415/183 |
| 3,209,987 | 10/1965 | Jennings . | |
| 3,267,506 | 8/1966 | Van Patten | 15/104.011 |
| 3,743,443 | 7/1973 | Jennings . | |
| 4,529,354 | 7/1985 | Klepesch | 415/202 |
| 4,715,778 | 12/1987 | Katayama et al. | 415/201 |
| 4,747,752 | 5/1988 | Somarakis | 417/68 |
| 4,759,382 | 7/1988 | Harel | 137/561 A |
| 4,862,549 | 9/1989 | Criswell et al. | 15/104.05 |
| 5,100,300 | 3/1992 | Haavik | 417/69 |

FOREIGN PATENT DOCUMENTS

| | | | |
|---|---|---|---|
| 2619889 | 3/1989 | France | 285/132 |
| 0651908 | 10/1985 | Switzerland | 285/132 |
| 1203938 | 9/1970 | United Kingdom | 15/104.05 |

*Primary Examiner*—Edward K. Look
*Assistant Examiner*—Christopher Verdier
*Attorney, Agent, or Firm*—Ralph H. Dougherty

[57] ABSTRACT

An improved water delivery system for a liquid ring vacuum pump which delivers water through the side of the pump wall. A manifold system aligns outlet ports of the manifold with the inlet ports of the pump itself. Access ports with plugs or caps are also aligned with the pump inlet ports, to provide a quick and easy access to clean out sediment from the manifold. The improved manifold system allows efficient employment of secondary plant liquid in the operation of a liquid ring vacuum pump.

23 Claims, 5 Drawing Sheets

MANIFOLD FOR A LIQUID RING VACUUM PUMP-COMPRESSOR

CROSS REFERENCE TO RELATED APPLICATION

This application is a continuation-in-part of our copending U.S. patent application Ser. No. 07/882,820, filed May 14, 1992, now U.S. Pat. No. 5,246,348.

FIELD OF THE INVENTION

The present invention relates to water inlets for liquid ring vacuum pumps, and more particularly to an apparatus, the use of which will result in lowering present maintenance time and cost over the operating life of the pump while retaining the efficiency of pump operation throughout its operating life, and for reducing the amount of fresh water required in the operation of the pump. Specifically the invention is a manifold for transporting secondary water into a liquid ring vacuum pump for cooling and operational purposes.

BACKGROUND OF THE INVENTION

Liquid ring vacuum pumps, as exemplified by Roe et al U.S. Reissue Pat. No. 29,747, which is incorporated herein by reference, use "seal water" for two purposes, first to form a liquid ring of working pistons that compress the gas and push it out of the pump, and second to form a seal between high pressure gas being discharged and low pressure gas entering the pump. This seal is formed in the angular segment land area of the 360 degree cycle, where the liquid ring pistons contact the cone surface. As used herein, the land, or land area, of the cone shall mean that portion of the cone which is in closest communication with the working water pistons. The efficiency of the pump depends on the seal created by both the clearance of the metal surfaces of the rotor vanes and cone surface and the pistons contacting the cone land area.

Shaft packing rings in a "stuffing box" require water for both sealing and cooling. If secondary (or recycled) water is pumped into the liquid ring pump through the center of the cone, then fresh water is piped separately into the stuffing box to avoid erosion of the shaft.

Metal parts of a liquid ring pump, particularly the vane surface at the inner tapered diameter of vanes and the cone land area surface, become worn during operation, causing an opening of clearances and subsequent loss of efficiency. After an extended time in operation, costly replacement or repair of the worn parts is required to rebuild the pump in order for it to perform anywhere approaching its original efficiency. Using only clean fresh water with known liquid ring vacuum pumps will reduce the cause for repair of such pumps, but with ever increasing costs for use of fresh water, and sometimes limited fresh water availability, use of 100% fresh water has become expensive or prohibitive. Also, the pre-treatment/filtration equipment necessary to remove suspended particulates from the secondary plant water to produce water with the degree of cleanliness that would minimize the erosive wear is both costly to purchase and expensive to operate and maintain. Additionally, a problem with using secondary plant water for sealing water is that it contains erosive particulates and will wear away the metal, both on the inner surface of the rotor vanes at the small diameter end of the tapered cone, and on the land area of the cone. This loss of metal weakens the liquid seal in the land area and causes an early loss of pump efficiency, thereby causing the need for costly pump repairs.

It is not recommended to use secondary plant water to seal and cool the shaft packing rings, since secondary plant water contains particles that would be captured between the shaft and packing, and cause excessive wear of the shaft material. Clean fresh water is piped separately to the stuffing box that holds the packing rings.

Secondary plant water can be used to form the piston of the pump, thereby saving fresh water. Secondary plant water contains sediment and particulates which over time will accumulate in the manifold delivery system. The result is an inadequate supply of secondary water to assure adequate cooling. To correct this condition it would be necessary to remove the manifold to clean out the accumulated sediment which is costly both in terms of down time of the pump and in labor costs.

DESCRIPTION OF THE PRIOR ART

Applicants are aware of the following U.S. Patents concerning

| U.S. Pat. No. | Inventor | Title |
|---|---|---|
| 3,209,987 | Jennings | LIQUID RING PUMP |
| 3,743,443 | Jennings | VACUUM PUMP |
| Re. 29,747 | Roe et al. | LIQUID RING PUMP LOBE PURGE |
| 4,747,752 | Somarakis | SEALING AND DYNAMIC OPERATION OF A LIQUID RING PUMP |

Jennings U.S. Pat. No. 3,209,987 is exemplary of liquid ring pumps over which the present invention is an improvement.

Jennings U.S. Pat. No. 3,743,443 teaches a seal apparatus in a central groove between successive stages, and a deflector blade for cooling the packing gland. The liquid is introduced into the pump through a pipe running parallel to the shaft and introduced into the pump around the cone in the middle of the rotor.

Roe et al. U.S. Reissue Pat. No. 29,747 teaches apparatus for purging or draining of contaminants from a liquid ring pump.

Somarakis U.S. Pat. No. 4,747,752 teaches apparatus for sealing the shaft and redirecting leakage toward a low pressure area. Here, liquid is introduced into the pump through a pipe just underneath the shaft of the pump. All the liquid is introduced in the same area.

SUMMARY OF THE INVENTION

The invention provides a manifold apparatus having a structure which allows quick and simple access to the interior of the manifold. The structure includes a water intake pipe which then branches off into usually four water discharge pipes. Opposite, and aligned with the same axis as the water discharge pipe is a cap or plug which is secured by means of a screw type threading. When water flow to the pipe becomes restricted, or on regularly scheduled intervals, sediment is removed by shutting off the water flow to the pump, removing the caps from the manifold, then inserting a brush, hook, or dowel rod into the manifold through the openings to clear out any sediment or debris which has accumulated therein. After the sediment and debris is cleared out the caps are replaced and secured, and the water flow is resumed.

During normal operation, secondary water is introduced through the housing wall into the annular peripheral space near the interior of the housing wall to provide the water necessary to form the working piston of the pump. Clean fresh water flows through the cone to the land area, forming a liquid seal.

The present invention solves the problem of sediment build-up within the manifold, which restricts the flow of water to the pump. At regularly scheduled intervals, the manifold is easily and quickly cleaned assuring that there will always be an adequate supply of secondary plant water to form the working piston of the pump.

The invention also solves the environmental problem caused by requiring too much fresh water in the operation of a liquid ring vacuum pump. Clean fresh water is only used where it is essential. Secondary plant water is used more effectively by delivering it to the location within the pump where its usage will cause the fewest problems. The invention uses secondary plant water more efficiently because the maintenance time associated with using secondary plant water has been drastically reduced.

OBJECTS OF THE INVENTION

The principal object of the invention is to provide apparatus for delivering fluid such as water through the water through a wall of a housing of a liquid ring vacuum pump.

It is also an object of the invention to provide means for reducing cleaning time to the secondary plant water manifold of a liquid ring vacuum pump.

Another object of this invention to provide quick access to the interior of the manifold.

Another object of the invention is to provide access to the intake water orifices on the liquid ring vacuum pump.

Another object of the invention is to provide a method of using inexpensive secondary plant water to form the working piston of the pump.

Another object of the invention is to provide an adequate seal at the cap in the manifold, to avoid leakage during normal operation.

A further object of this invention is to provide direct access to the manifold for the removal of sediment.

BRIEF DESCRIPTION OF THE DRAWINGS

The foregoing and other objects will become more readily apparent by referring to the following detailed description and the appended drawings in which.

DETAILED DESCRIPTION

Figure 5:
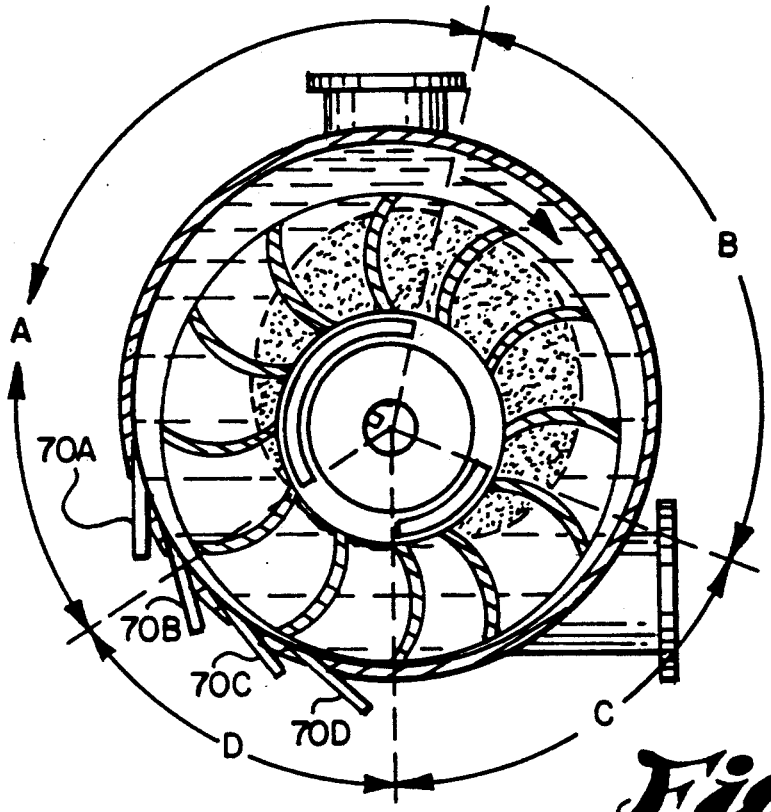
FIG. 5 is a schematic cross section of a liquid ring vacuum pump showing a working piston, and secondary water injection, in accordance with the present invention.

The four stages of liquid ring pump operation, which take place about specific angular segments of the cone, as depicted in FIG. 5, are: the gas inlet or intake stage A, the gas compression stage B, the compressed gas discharge stage C, and the liquid seal stage D, the last of which occurs at the land area.

Figure 1:
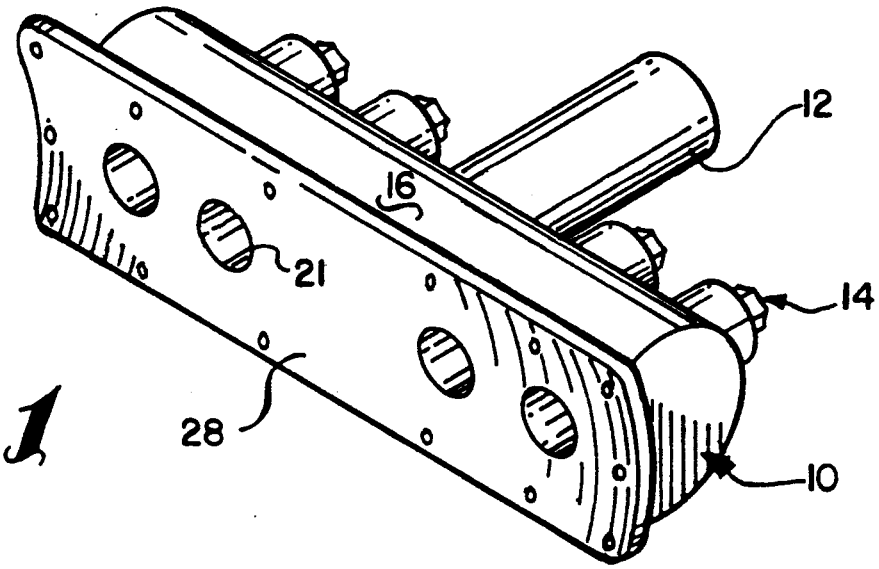
FIG. 1 is an isometric view of a manifold adapted for flush mounting with a liquid ring vacuum pump.
Figure 3:
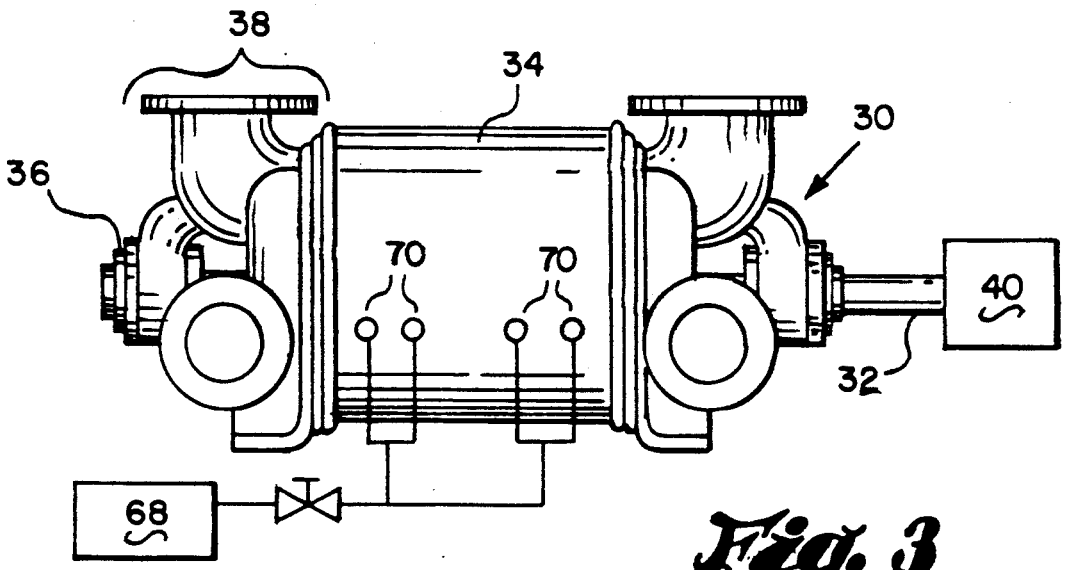
FIG. 3 is a side elevational view of a liquid ring vacuum pump showing schematically secondary water injection, and associated control system.

Referring now to the drawings, in FIG. 1, a flush mount manifold 10 for make-up water of the liquid ring vacuum pump receives water through water intake pipe 12 and distributes the water across manifold distribution tube 16, which feeds the water directly into pump 30 through make-up water injection orifices or intakes 70, as seen in FIG. 3. The flush mount manifold 10 is provided with caps 14 for direct access to the interior of manifold distribution tube 16. Each cap 14 preferably is provided with threads 22 for engaging internally threaded cap receptacles in the manifold distribution tube 16. The orifices 21 of the manifold or the discharge pipes 20 can be inclined to mate and be in axial alignment with water injection inlets 70A, 70B, 70C or 70D, as shown in FIG. 5, whereby the axes of the opposing caps 14 will also be aligned with the axes of the mating orifices 70, 21 or orifices 70 and pipes 20, and parallel with each other cap axis. A nut-type square head 26 is used to remove the cap. The flush mount manifold 10 is affixed directly to the pump housing 34 by connecting flange 28 to the housing, as with bolts.

Figure 4:
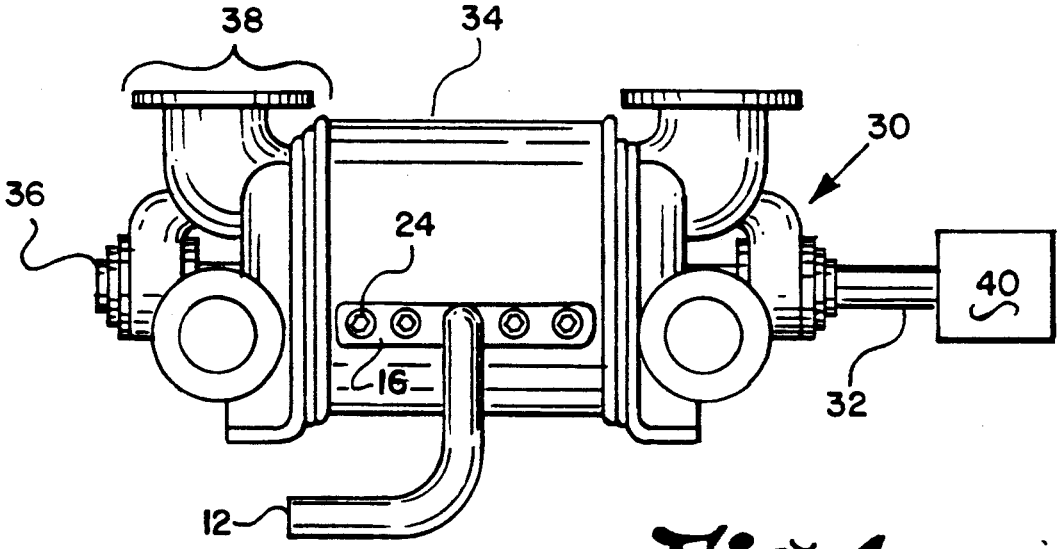
FIG. 4 is a side elevational view of a liquid ring vacuum pump showing a manifold in place.
Figure 6:
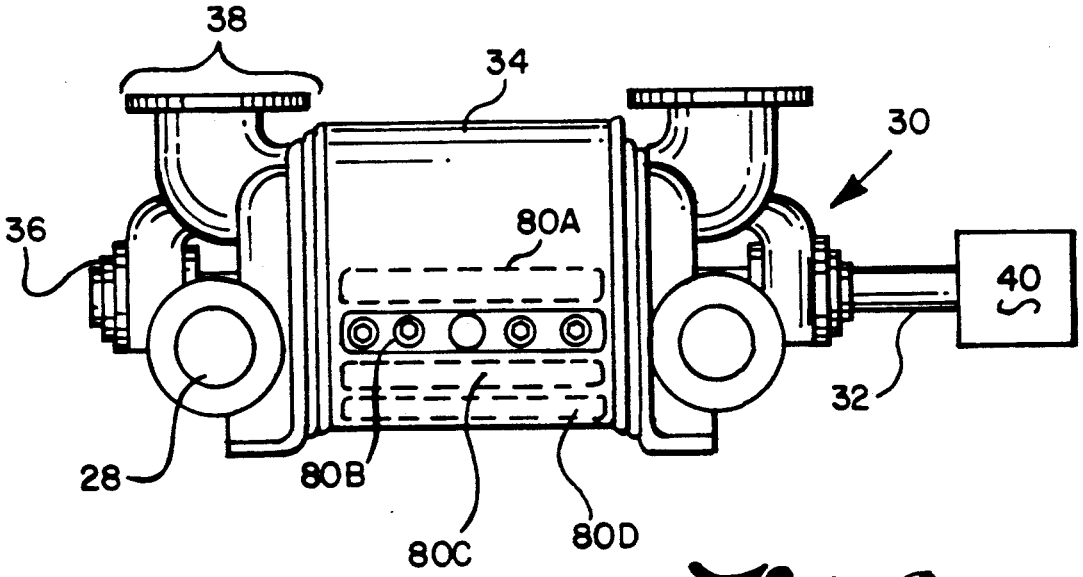
FIG. 6 is a side elevational view of the liquid ring vacuum pump of FIG. 3 showing alternative placements of the manifold.

Overall, the pump 30 is shown without the manifold distribution tube 16 in FIG. 3. In operation, a motor 40 drives a shaft 32 through a bearing housing 36. Gas is injected into the pump through an inlet passageway 38. Make-up secondary plant water from a source 68 is fed into the pump through the manifold. The manifold distributes the water through the wall of the pump housing 34 through the injection orifices 70. The manifold distribution tube 16 is attached to the pump 30 as shown in FIG. 4. The manifold distribution tube 16 can be attached to the pump 30 at positions 80A, 80B, 80C, or 80D, as shown in FIG. 6. As indicated in FIG. 5, those positions on the exterior of the pump 30 correspond with positions 70A, 70B, 70C, and 70D in FIG. 5, which is a diagram of the inside of the pump. It is preferred that make-up water be injected tangentially in the same direction as the direction of rotation of the pump to avoid any extraneous water ejection along with compressed gas. The optimum location for make-up water injection is 70D opposite the land area section D.

ALTERNATIVE EMBODIMENTS

Figure 2:
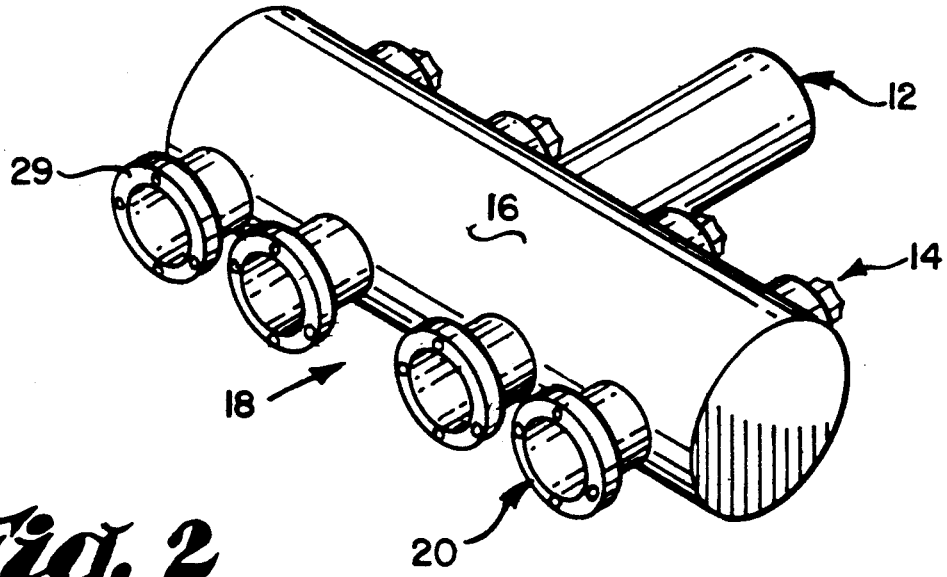
FIG. 2 is an isometric view of a manifold having individual water outlet pipes.

Alternatively, the standard mount manifold 18 may be mounted at a spaced distance away from the pump housing 34 by using water discharge pipes 20, shown in FIG. 2. Discharge pipes 20 each have a flange 29 shown in FIG. 2 and are mounted to the pump housing 34 by affixing each flange 29 thereto. In the alternative embodiment of FIG. 8, pipe 46 is threaded at both ends in opposite directions, whereby insertion of the pipe 46 in threaded manifold orifice 64 and in threaded housing orifice 70, then rotation of the pipe 46 attaches the manifold distribution tube 16 FIG. 8 to the pump housing 34 by drawing them together.

Figure 8:
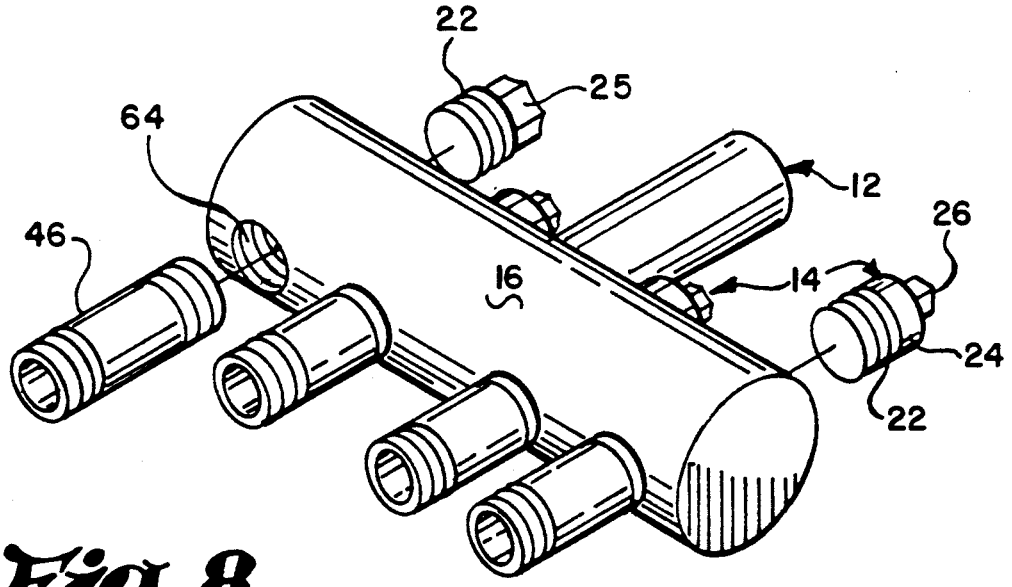
FIG. 8 is an isometric view of an alternative embodiment of a manifold having dual threaded outlet pipes, and two alternative manifold caps, a cap with square or nut-mounted head, and a cap with a hexagonal head.

The cap 24 in FIG. 8 can also be provided with a torque fitting, allen, screw head or similar fitting in place of the nut 26. The cap 25 in FIG. 8 can have any convenient configuration such as hexagonal or square shape to facilitate removal with a wrench.

Figure 9:
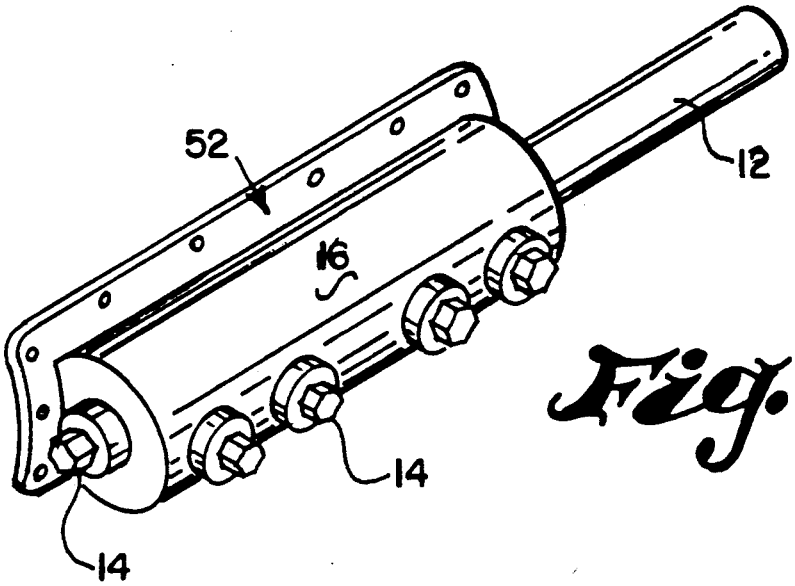
FIG. 9 is an isometric view of another alternative manifold embodiment in which a flush mounted manifold has a water intake pipe connected to the end of the manifold distribution tube.

The water intake pipe 12 may be branched, or connected to the end of the manifold distribution tube 16 as shown in FIG. 9. A removable cap 14 is situated opposite the water intake pipe to provide access to the interior of the manifold distribution tube 16.

The cap 24 shown in FIG. 8 can be fitted with a gasket to insure a secure seal. A gasket may also be employed between the manifold distribution tube 16 and the pump housing when the tube 16 is bolted to the housing.

While the drawings show four discharge tubes 20 or orifices 21, (see FIG. 1), with opposed caps 14 on the manifold distribution tube 16, it is possible to use more or fewer tubes or orifices, depending on the pump design. Note that the depicted pump 30 is a double cone pump, with two intakes 70 for each cone.

Figure 7:
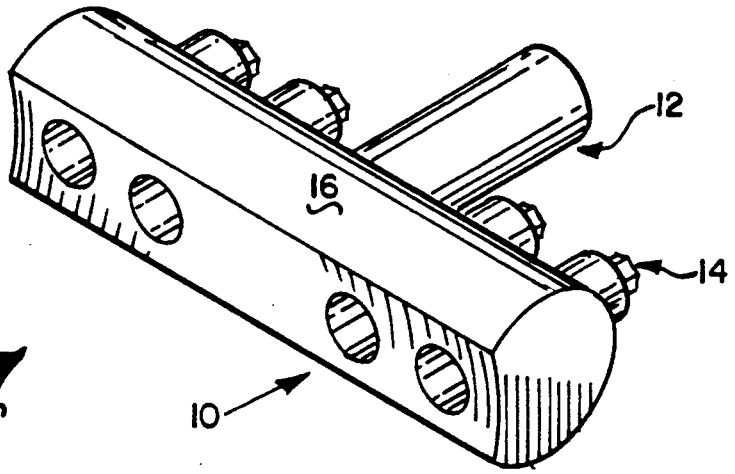
FIG. 7 is an isometric view of an alternative embodiment of a manifold adapted for flush mounting on a liquid ring vacuum pump housing.

The elongated flush mount manifold 10 may be cast or otherwise fabricated without a flange 28 as shown in FIG. 7. This manifold can be welded to the pump housing 34 or it may be cast directly into the pump housing 34.

Figure 10:
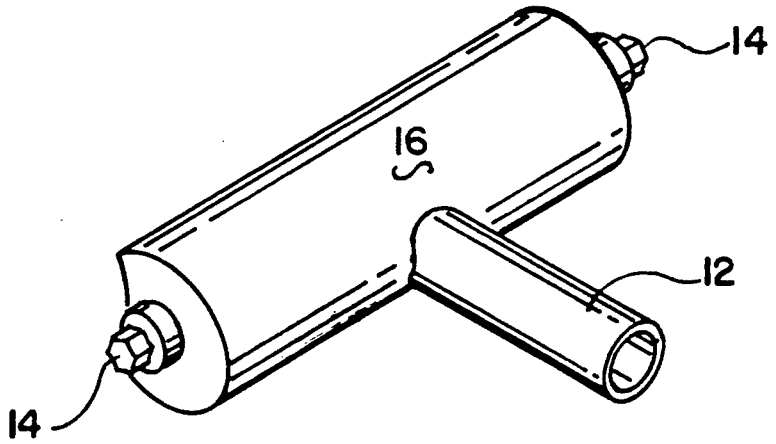
FIG. 10 is an isometric view of a further alternative embodiment in which a manifold has caps at both ends of the manifold distribution tube.

Additionally a manifold 10 may employ a cap 14 at either or both ends of the manifold distribution tube 16 as shown in FIG. 10, or may employ both end caps and caps mounted axially with the orifices in the pump housing.

SUMMARY OF THE ACHIEVEMENT OF THE OBJECTS OF THE INVENTION

From the foregoing, it is readily apparent that we have invented an improved method and apparatus for effectively delivering secondary plant water, to be used in a liquid ring vacuum pump, through the wall of the pump housing. The manifold affords quick and easy access for cleaning, which will be necessitated by the use of secondary plant water, as well as an inspection port.

It is to be understood that the foregoing description and special embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A liquid ring vacuum pump or compressor apparatus having sequentially an inlet segment, a compression segment, a discharge segment, and a seal segment, a generally annular housing having a longitudinal axis; a rotor mounted for rotation within said housing, and having vanes extending generally radially therefrom, forming a plurality of working chambers; a port-containing member through which a pumped medium is admitted to and discharged from said working chambers; means for introducing water to the face of said port containing member between said member and the end of said vanes adjacent said member; and means for introducing water to the interior of said chamber through said annular housing, the improvement comprising:

at least two orifices in the wall of said housing;

said means for introducing water to the interior of said chamber being a manifold having an elongated water distribution tube, at least one inlet pipe connected to a source of water and to said tube, and at least two outlets communicating with said tube and the interior of said pump through said at least two orifices in the wall of said housing; and removable caps positioned on said manifold in axial alignment with and opposite each said orifice in said housing.

2. Apparatus according to claim 1, wherein said manifold outlets comprise at least two water discharge pipes communicating with the interior of said distribution tube.

3. Apparatus according to claim 2 wherein said discharge pipes are threadedly attachable to said manifold and said housing.

4. Apparatus according to claim 2 wherein said discharge pipes are connected to said housing by flanges.

5. Apparatus according to claim 2 wherein said inlet pipe is centered between the water discharge pipes or orifices.

6. Apparatus according to claim 1 wherein said manifold is mounted flush against said pump housing, and sealed thereto.

7. Apparatus according to claim 6 wherein each of said manifold outlets mate with an orifice in the wall of said housing.

8. Apparatus according to claim 1 wherein said inlet pipe communicates with one end of said manifold.

9. Apparatus according to claim 1 wherein said inlet pipe communicates with one end of said manifold, further comprising a removable cap positioned on said manifold opposite and in axial alignment with said water inlet pipe.

10. Apparatus according to claim 1, further comprising a removable cap positioned on at least one end of said manifold.

11. A liquid ring vacuum pump or compressor apparatus having sequentially an inlet segment, a compression segment a discharge segment, and a seal segment, a generally annular housing having a longitudinal axis; a rotor mounted for rotation within said housing, and having vanes extending generally radially therefrom, forming a plurality of working chambers; a port-containing member through which a pumped medium is admitted to and discharged from said working chambers; means for introducing water to the face of said port containing member between said member and the end of said vanes adjacent said member; and means for introducing water to the interior of said chamber through said annular housing, the improvement comprising;

at least two orifices in the wall of said housing;

said means for introducing water to the interior of said chamber being a housing having an elongated water distribution tube, at least one inlet pipe connected to a source of water and to said tube, and at least two outlets communicating with said tube and the interior of said pump through said at least two orifices in the wall of said housing; and a removable cap positioned on at least one end of said housing, said water inlet pipe communicating with the center of said manifold, perpendicular to the longitudinal axis of said water distribution tube.

12. Apparatus according to claim 11, wherein said manifold outlets comprise at least two water discharge pipes communicating with the interior of said distribution tube.

13. Apparatus according to claim 12 wherein said inlet pipe is centered between the water discharge pipes or orifices.

14. Apparatus according to claim 11 wherein said manifold is mounted flush against said pump housing, and sealed thereto.

15. Apparatus according to claim 14 wherein each of said manifold outlets mate with an orifice in said housing.

16. A liquid ring vacuum pump or compressor apparatus having sequentially an inlet segment, a compression segment, a discharge segment, and a seal segment, a generally annular housing having a longitudinal axis; a rotor mounted for rotation with said housing, and having vanes extending generally radially therefrom, forming a plurality of working chambers; a port-containing member through which a pumped medium is admitted to and discharged from said working chambers; means for introducing water to the face of said port containing member between said member and the end of said vanes adjacent said member; and means for introducing water to the interior of said chamber through said annular housing, the improvement comprising:

at least two orifices in the wall of said housing;

said means for introducing water to the interior of said chamber being a manifold having an elongated water distribution tube, at least one inlet pipe connected to a source of water and to said tube, and at least two outlets communicating with said tube and the interior of said pump through said at least two orifices in the wall of said housing; and a secondary water source and a conduit connecting said secondary water source to manifold.

17. Apparatus according to claim 16, wherein said manifold outlets comprise at least two water discharge pipes communicating with the interior of said distribution tube.

18. Apparatus according to claim 17 wherein said discharge pipes are threadedly attachable to said manifold and said housing.

19. Apparatus according to claim 17 wherein said discharge pipes are connected to said housing by flanges.

20. Apparatus according to claim 17 wherein said inlet pipe is centered between the water discharge pipes or orifices.

21. Apparatus according to claim 16 wherein said manifold is mounted flush against said pump housing, and sealed thereto.

22. Apparatus according to claim 21 wherein each of said manifold outlets mates with an orifice in the wall of said housing.

23. Apparatus according to claim 16 wherein said inlet pipe communicates with one end of said manifold.

* * * * *

UNITED STATES PATENT AND TRADEMARK OFFICE

CERTIFICATE OF CORRECTION

PATENT NO. : 5,290,152
DATED : March 1, 1994
INVENTOR(S) : T. Michael Wallace, Charles H. Wunner It is certified that error appears in the above-identified patent and that said Letters Patent is hereby corrected as shown below:

In the Specification:

Column 2,
Line 24, after "concerning", insert -- liquid ring pumps: --.

In the Claims:

Claim 11, column 6,
Line 50, change "segment a discharge" to -- segment, a discharge --.
Line 65, change "housing" to -- manifold --.

Claim 11, column 7,
Line 4, change "housing" to -- mainfold --.

Claim 16, column 7,
Line 26, change "with" to -- within --.

Claim 16, column 8,
Line 12, change the phrase "to manifold" to -- to said manifold --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*